United States Patent [19]

Richards

[11] Patent Number: 4,813,246

[45] Date of Patent: Mar. 21, 1989

[54] METHOD OF SETTING PRECIOUS AND SEMIPRECIOUS STONES

[76] Inventor: Camille Richards, 18, avenue Emile Deschanel, 75007 Paris (Seine), France

[21] Appl. No.: 832,245

[22] Filed: Feb. 24, 1986

[30] Foreign Application Priority Data

Mar. 7, 1985 [FR] France ..... 85 03384

[51] Int. Cl.[4] ..... A44C 17/02

[52] U.S. Cl. ..... 63/26; 63/28

[58] Field of Search ..... 63/26, 27, 28; D11/89, D11/90, 91, 92; 228/903, 122; 164/34, 35

[56] References Cited

U.S. PATENT DOCUMENTS 2,790,220 4/1957 Fox ..... 164/35
3,192,620 7/1965 Huizing et al. ..... 228/122
4,154,282 5/1979 Kull ..... 164/34

FOREIGN PATENT DOCUMENTS 802367 9/1936 France ..... 63/28
432074 7/1935 United Kingdom ..... 63/28

*Primary Examiner*—Richard J. Johnson
*Assistant Examiner*—Kevin G. Rooney
*Attorney, Agent, or Firm*—Browdy and Neimark

[57] ABSTRACT

A precious stone setting, especially for diamonds, is achieved without adversely affecting the value of the stones, and in an essentially invisible way, by forming slight notches at the angles of the culet in such a way that the depth of the notches is small and the distance separating the bottom of two opposite notches is very much greater than the width of the table of the stone. A metal matrix is used to hold the stone, the metal penetrating into the notches.

4 Claims, 1 Drawing Sheet

METHOD OF SETTING PRECIOUS AND SEMIPRECIOUS STONES

BACKGROUND OF THE INVENTION

1. Field of the Invention

The present invention relates to a method of setting precious and semiprecious stones, applicable to all jewels and more particularly to diamonds. The invention also covers the settings obtained by means of this process.

2. Description of the Prior Art

At the present time the setting of precious stones and diamonds is known but it is very difficult to obtain an invisible setting or a setting which does not adversely affect the value of the stone. Present settings in fact imply the formation of relatively deep notches on the culet of the stones, for receiving metal holding pieces. Thus longitudinal notches may be formed sliding over rails of the mount, or else notches at the angles of the culet receiving metal claws of said mount. In both cases, the notches must be deep in order to provide reliable fixing, but such deep notches cannot be used with diamonds for they destroy the luster thereof and thus adversely affect their value. Such a method is for example described in French Pat. No. 802 367.

SUMMARY OF THE INVENTION

The present invention aims then at overcoming such disadvantages by providing a simple and rapid setting method which cannot adversely affect the value of the stones, in particular diamonds whose setting remains invisible and luster unchanged.

In accordance with the invention, on each stone slight notches are formed at the angles of the culet, whose small depth is such that the distance separating the bottom of two opposite notches is very much greater than the width of the table of the stone, the whole of the mounted stones is provisionally held in position by masking their table side then a metal is run so as to form a holding grid on the culet side.

Thus, the metal penetrates into the notches while forming said grid as a single perfectly solid block, the elements of the grid occupying a restricted space placed so that they are invisible on the table side.

BRIEF DESCRIPTION OF THE DRAWINGS

Other features and advantages of the invention will be clearer from the following description with reference to the accompanying drawings in which.

In these drawings the same reference designate the same elements.

DESCRIPTION OF THE PREFERRED EMBODIMENT

Figure 1:
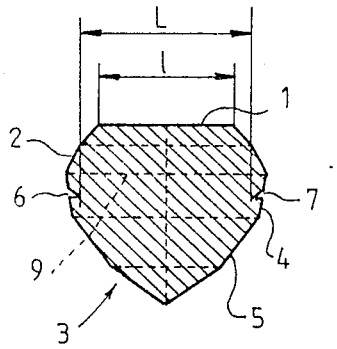
FIG. 1 shows an elevational view in section along a diagonal line 2—2 of FIG. 2 of a squared diamond to which the method of the invention is applied.
Figure 2:
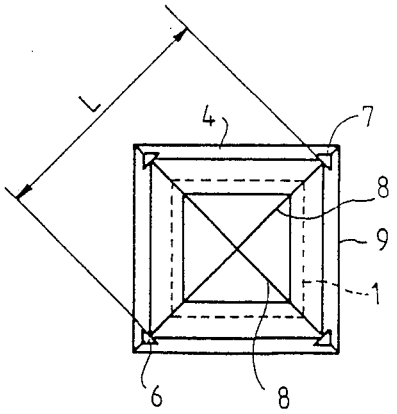
FIG. 2 shows a schematical plan view from the culet side of a diamond according to FIG. 1.

Referring to FIGS. 1 and 2, a jewelery diamond comprises a table 1 of diagonal width 1 with for example two facets 2 and a culet generally referenced 3, normally having facets such as facets 4 and 5. In accordance with the invention, a very slight notch 6 is formed (shown very much enlarged for the sake of clarity) at each corner 8 of the culet formed by the facet 4 of said culet adjacent the girdle 9 which defines the upper part 1, 2 and the culet 3 of the stone. As mentioned above, the notches have a very small depth and the distance L separating the bottom of two opposite notches 6, 7 is very much greater than the diagonal width 1 of the table 1 and does not extend inwardly beyond the first facet 2 adjacent the girdle 9. Such miniaturized notches are advantageously formed using a "laser" so that they have the required fineness and precision.

Figure 3:
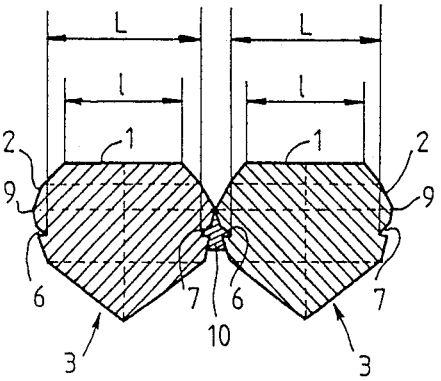
FIG. 3 is a schematical view in elevation and in section of an assembly of two juxtaposed diamonds.
Figure 4:
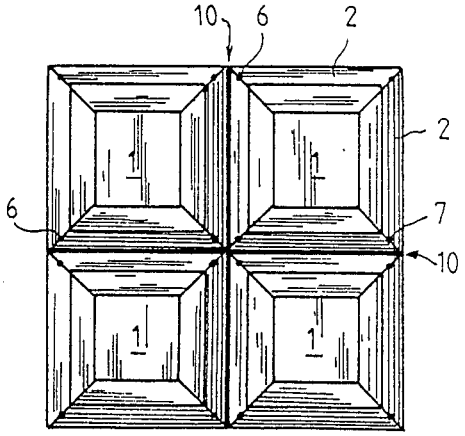
FIG. 4 shows a schematical plan view from the table side of an assembly of diamonds.

Referring to FIGS. 3 and 4, for the setting operations, the whole of the mounted stones is temporarily held in position in the desired shape, for example by means of modelling wax in which the culets 3 are inserted whereas the table side of the stones is masked with plaster forming a stable support. Then the wax is removed, which is replaced by a synthetic resin which, by hardening, forms a support block which is then introduced into a molding cylinder known per se in the jewellery trade and in which a metal is run under pressure, for example a gold alloy. The resin is then removed and destroyed, whereas the liquid metal enters into the notches 6, 7 although only slight and forms a thin pad 10 between the facets 4 adjacent the girdle 9 of the juxtaposed stones. The pads 10 thus formed constitute the elements of a metal grid in a single block and, because of the slope of facets 2 as well as the fact that neither the notches already practically invisible in themselves nor the pads are disposed in line with the tables 1 of the stones, the grid thus formed remains invisible from the table side while providing perfectly firm fixing. It is clear that this arrangement has a considerable advantage with respect to the rail or claw mounting methods requiring deeper notches and that it does not adversely affect the value ofthe stones, because of the miniaturization of the notches.

It will of course be readily understood that the present invention has been described and shown by way of explanation which is in no wise limiting and that any useful modification may be made thereto particularly within the field of technical equivalences without departing from its scope or spirit. In particular, although stones of a general square shape have been shown, the method applies to any polygonal shapes of stones.

What is claimed is:

1. A method of setting precious and semiprecious stones, in particular diamonds, comprising an upper part forming a table, said table having first adjacent facets, and a lower part forming a culet, said upper and lower parts being defined by a girdle, said girdle having second adjacent facets in said lower part, wherein slight notches are formed at each corner formed by said second facets of the culet adjacent said girdle, whose small depth is such that the distance separating the bottom of two diagonally opposite notches is very much greater than the diagonal width of the table and does not extend inwardly beyond said first facets adjacent said gridle, the stones are mounted and they are temporarily held in position, then a metal is cast on the mounted stones so as to form a holding grid on the culet side by insertion of said metal in said notches.

2. The method as claimed in claim 1, wherein the stones are temporarily held in position in the desired form by means of wax in which the culets of said stones are inserted and the table side of the stones is protected by means of plaster, then said wax is replaced by a curable resin forming a support, and the metal is cast, whereby said resin is removed and replaced by the formation of said holding grid.

3. The method as claimed in claim 1, wherein the metal is cast under pressure.

4. A method of setting precious and semiprecious stones, said stones having a table formed on an upper part thereof, said table having first adjacent facets, a culet formed by a lower part of said stone, and a gridle separating said upper and lower parts, said girdle having second adjacent facets near said lower part, said method comprising the steps of:

forming a plurality of small notches at each corner formed by the second facets of the culet adjacent to the girdle, said notches having a small depth such that the distance separating the bottom of two diagonally opposite notches is substantially greater than the diagonal width of the table and does not extend inwardly beyond the first facets adjacent to the girdle;

mounting the stones and temporarily holding them in position; and casting a metal on the mounted stones so as to form a holding grid on the culet side of the stones by insertion of the metal in said notches.

* * * * *